US011897665B2

(12) United States Patent
Schoenmakers et al.

(10) Patent No.: US 11,897,665 B2
(45) Date of Patent: Feb. 13, 2024

(54) CLOSURE FOR A CONTAINER

(71) Applicant: Weener Plastics Group B.V., Ede (NL)

(72) Inventors: Antonetta Johanna Maria Schoenmakers, Udenhout (NL); Dennis Antonius Wilhelmus Maria van Meurs, 's-Hertogenbosch (NL)

(73) Assignee: Weener Plastics Group B.V., Ede (NL)

( * ) Notice: Subject to any disclaimer, the term of this patent is extended or adjusted under 35 U.S.C. 154(b) by 64 days.

(21) Appl. No.: 17/424,202

(22) PCT Filed: Jan. 20, 2020

(86) PCT No.: PCT/NL2020/050027
§ 371 (c)(1),
(2) Date: Jul. 20, 2021

(87) PCT Pub. No.: WO2020/153836
PCT Pub. Date: Jul. 30, 2020

(65) Prior Publication Data

US 2022/0106083 A1 Apr. 7, 2022

(30) Foreign Application Priority Data

Jan. 21, 2019 (NL) ..... 2022425

(51) Int. Cl.
*B65D 43/16* (2006.01)
*B65D 51/24* (2006.01)

(52) U.S. Cl.
CPC ..... *B65D 43/162* (2013.01); *B65D 43/164* (2013.01); *B65D 43/169* (2013.01);
(Continued)

(58) Field of Classification Search
CPC ..... B65D 43/162; B65D 51/246; B65D 2543/00435; B65D 55/16; B65D 41/3423
See application file for complete search history.

(56) References Cited

U.S. PATENT DOCUMENTS

2007/0114236 A1 5/2007 Shiffer et al.
2008/0068178 A1* 3/2008 Meyer ..... B65D 41/3423 340/572.8

(Continued)

FOREIGN PATENT DOCUMENTS

EP 0 213 742 A2 3/1987
WO 96/19388 A1 6/1996

(Continued)

OTHER PUBLICATIONS

First Office Action, Chinese Application No. 202080015484.0, dated Sep. 6, 2022, 10 pages.

*Primary Examiner* — Jeffrey R Allen
(74) *Attorney, Agent, or Firm* — Hoffmann & Baron, LLP

(57) ABSTRACT

A closure includes an annular base to be fixed to an upper rim of a container. The base includes a peripheral skirt having an end portion to be arranged over the upper rim of the container. A peripheral locking rim is integrally formed on the end portion of the peripheral skirt. The locking rim has a proximal end hingedly connected to the peripheral skirt and allowing the peripheral locking rim to be folded inwardly towards an inner surface of the end portion, such that, when the locking rim is in the folded state, a distal end thereof can move beyond and engage under a peripheral ledge of the container to lock the base to the container. The end portion of the skirt has on the inner surface an engagement surface portion and a widening surface portion towards an end of the peripheral skirt.

15 Claims, 4 Drawing Sheets

(52) U.S. Cl.
CPC .. *B65D 51/246* (2013.01); *B65D 2543/00092* (2013.01); *B65D 2543/00435* (2013.01)

(56) References Cited

U.S. PATENT DOCUMENTS

2017/0203890 A1* 7/2017 Lenz ..... B65D 51/26
2021/0347533 A1* 11/2021 Lenz ..... B65D 43/169

FOREIGN PATENT DOCUMENTS

WO 2013/036820 A1 3/2013
WO 2016/022744 A1 2/2016

* cited by examiner

CLOSURE FOR A CONTAINER

CROSS-REFERENCE TO RELATED APPLICATIONS

This application is the National Stage of International Application No. PCT/NL2020/050027, filed Jan. 20, 2020, which claims the benefit of Netherlands Application No. 2022425, filed Jan. 21, 2019, the contents of which is incorporated by reference herein.

FIELD OF THE INVENTION

The present invention relates to a closure for a container, wherein the container has an open top side defined by an upper rim comprising an outwardly extending peripheral ledge surrounding said open top side. The closure comprises an annular base to be fixed to the upper rim of the container and defining an access opening to the container, and the closure further comprises a lid moveable relative to the annular base between a closed position, in which the lid covers the access opening, and an open position, in which the access opening is unblocked by the lid. The annular base comprises a peripheral skirt which has an integral non-removable end portion adapted to be arranged over the upper rim of the container, and furthermore comprises a peripheral locking rim integrally formed on said end portion of the peripheral skirt, said peripheral locking rim having a proximal end and a distal end. The proximal end of the peripheral locking rim is hingedly connected to the peripheral skirt, allowing the peripheral locking rim to be moved to a folded state, in which the peripheral locking rim is folded inwardly towards an inner surface of the end portion of the peripheral skirt, such that, when the locking rim is in the folded state, the distal end thereof can move beyond and engage under the peripheral ledge of the container to lock the closure base to the upper rim of the container.

BACKGROUND OF THE INVENTION

WO 96/19388 discloses a closure made of a plastics material and including a circumferential skirt having a lower portion where a locking member of a conical form is formed. The neck of the container includes an outwardly directed ledge. When the closure is assembled onto the neck of the container, the locking member strikes the ledge of the container and the locking rim is rotated about a hinge into an upwardly directed position. Upon further axial movement of the closure the locking member rides over the ledge until it enters an undercut such that its free end seats under the ledge. When the locking member is seated under the ledge the closure is effectively locked in place, whereby the skirt cannot be separated from the neck of the container without breaking or damaging the locking means or the container.

A similar closure including the same locking mechanism is disclosed in WO 2016/022744.

A problem that occurs with assembling the closure and the container is that the dimensions of the upper rim of the container may be subject to manufacturing tolerances in shape and dimensions. This can make it difficult to position the closure on the container, especially in an automated way.

The present invention has for an object to improve the positioning of the closure on the container.

SUMMARY OF THE INVENTION

This object is achieved by a closure for a container, wherein the container has an open top side defined by an upper rim comprising an outwardly extending peripheral ledge surrounding said open top side. The closure comprises an annular base to be fixed to the upper rim of the container and defining an access opening to the container, and the closure further comprises a lid moveable relative to the annular base between a closed position, in which the lid covers the access opening, and an open position, in which the access opening is unblocked by the lid. The annular base comprises a peripheral skirt which has an integral non-removable end portion adapted to be arranged over the upper rim of the container, and furthermore comprises a peripheral locking rim integrally formed on said end portion of the peripheral skirt, said peripheral locking rim having a proximal end and a distal end. The proximal end of the peripheral locking rim is hingedly connected to the peripheral skirt, allowing the peripheral locking rim to be moved to a folded state, in which the peripheral locking rim is folded inwardly towards an inner surface of the end portion of the peripheral skirt, such that, when the locking rim is in the folded state, the distal end thereof can move beyond and engage under the peripheral ledge of the container to lock the closure base to the upper rim of the container. The end portion of the skirt has on the inner surface an engagement surface portion with an inner diameter basically corresponding to the outer diameter of the peripheral ledge of the container and a widening surface portion having a gradually increasing inner diameter from the engagement surface portion towards the end of the peripheral skirt.

The closure according to the invention provides a guiding structure which guides the annular base over the upper rim of the container during assembly. The locking rim of the closure will engage the upper rim of the container and will be hinged to settle at least partly against the widening surface portion of the end portion of the skirt. Thus the locking rim provides a narrowing guiding surface for the ledge of the container, whereby the container is centred. The outer diameter of the locking rim, i.e. at the hinging connection with the peripheral skirt, is significantly larger than the outer diameter of the peripheral ledge of the container, such that an easy and reliable placement of the closure base on the upper rim of the container is possible and too much friction can be avoided when initially placing the annular base on the upper rim of the container.

According to the invention, the widening surface portion, which directly adjoins the engagement surface portion, has a gradually increasing inner diameter from the engagement surface portion towards the end of the peripheral skirt. The gradually increasing inner diameter may increase linearly such that a conical wall surface is formed, but the diameter may also increase non linearly following a curved function such that a curved wall surface is formed.

The widening surface portion preferably adjoins the engagement surface portion in a flush manner. An abrupt transition between the engagement surface portion and the widening surface portion is thus avoided. In particular this may be achieved by a diameter of the widening surface portion increasing according to a curved function.

In a possible embodiment the end portion of the skirt has a wall portion that increases in diameter towards an end of the end portion of the peripheral skirt. In this embodiment the end portion of the skirt thus flares towards the end thereof. This facilitates an easier better centring of the ledge of the container when the annular base is arranged on the top side of the container.

In a possible embodiment the proximal end of the locking rim is connected to an end of the end portion of the peripheral skirt. The proximal end of the locking rim is thus not connected to the inner surface of the skirt end portion. Thereby the locking rim interferes less with the ledge of the container while the locking rim moves past the ledge when the annular base is pushed on the top side of the container.

In a possible embodiment the proximal end of the locking rim is located radially outward with respect to the engagement surface portion. This feature facilitates the positioning and centring of the ledge of the container and furthermore reduces interference of the locking rim with the ledge while the locking rim moves past the ledge when the annular base is pushed on the top side of the container.

In a possible embodiment of the closure according to the invention the peripheral locking rim comprises a proximal portion and a distal portion, the proximal portion extending from the proximal end to an angle portion, the distal portion extending from the angle portion to the distal end, and wherein in the initial state the distal portion is inclined inwardly with respect to the proximal portion of the locking rim. Preferably, the proximal portion of the locking rim in the initials state extends substantially in alignment or concentric with the peripheral skirt of the annular base.

Preferably, the proximal portion has a gradually increasing thickness from the proximal end towards the angle portion. The proximal end is thus thinner which allows for a better hinge action.

The distal portion may have a substantially constant thickness.

In an alternative embodiment the locking rim has an inwardly curved shape.

In a possible embodiment of the closure according to the invention, the annular base furthermore comprises an inner skirt which is coaxial with the peripheral skirt and is integrally connected with the peripheral skirt at an upper side. Preferably the inner skirt in the fixed state on the container is located radially inward from the upper rim of the container. The inner skirt defines the passage through which a user can access the container to remove content, e.g. with a utensil.

In a possible embodiment the inner skirt has a lower end which in the fixed state on the container is located above and spaced apart from the upper rim of the container.

In a preferred embodiment of the closure according to the invention, the peripheral skirt has axially extending ribs on the inner side, wherein the ribs have an end near the end portion of the peripheral skirt, wherein said ends of the ribs form a stop for the upper side of the container.

Preferably, the axial distance between the end of the ribs and the distal end of the peripheral locking rim in the inwardly folded state is larger than the height of the peripheral ledge of the container.

In a practical embodiment of the closure according to the invention, the annular base and the lid are connected by a hinge.

The annular base and the lid may be formed in one piece, e.g. by injection moulding, wherein the hinge is a living hinge integrally formed with the annular base and the lid.

In another possible embodiment the annular base and the lid are separately formed parts which are assembled to form the closure. The lid and the annular base can for example be injection moulded in separate moulds and then interconnected by cooperating hinging elements integrally formed on the annular member and the lid, respectively.

In a possible embodiment of the closure the annular base has retaining members to retain a utensil adapted to take product from the container. Alternatively, the lid may have retaining members to retain a utensil adapted to take product from the container. In a practical embodiment the utensil may for example be a scoop which may in particular be useful for taking powdered or granular product from the container. Also other utensils are conceivable depending on the specific container and its contents, such as for example spatula, chopsticks, tweezers or other type of gripping tools.

The invention also relates to a method for manufacturing a closure as set out in the above, wherein the closure is formed by injection moulding.

It is noted that, following the common practice in the field of manufacturing this type of closure, the closure will generally be made of a plastics material, in particular a thermoplastic material such as a polypropylene (PP) or a polyethylene (PE). However, the use of alternative, preferably mouldable, materials, suitable for forming the closure is not excluded.

Preferably the locking rim of the closure is brought into the folded state just after it is removed from the injection mould. The closure is thus supplied to an assembly line for assembly with a container having the locking rim in the folded state. The locking rim thus provides a centering guiding surface for the ledge of the container, which facilitates automated assembly of the container and closure.

The invention also relates to an assembly of a closure as set out in the above and a container. In a foreseen practical application the container may contain a powdered product, such as baby formula, or a granular product. In another application the container may for example contain a product in tablet shape, for example sweetener tablets, tablets of dietary supplements or pharmaceutical tablets. Even pieces of candy or fruit may be received in the container.

The invention will be further elucidated with reference to the drawings.

DETAILED DESCRIPTION

Figure 3:
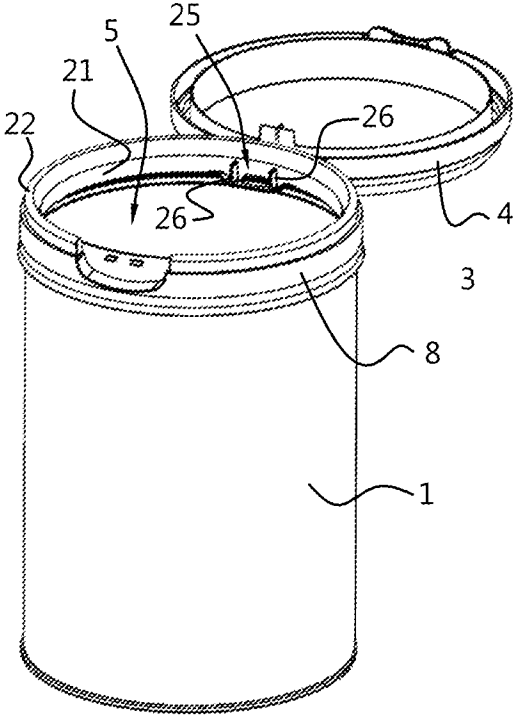
FIG. 3 shows a view in perspective of the same assembly as FIG. 2 but with the utensil removed.
Figure 2:
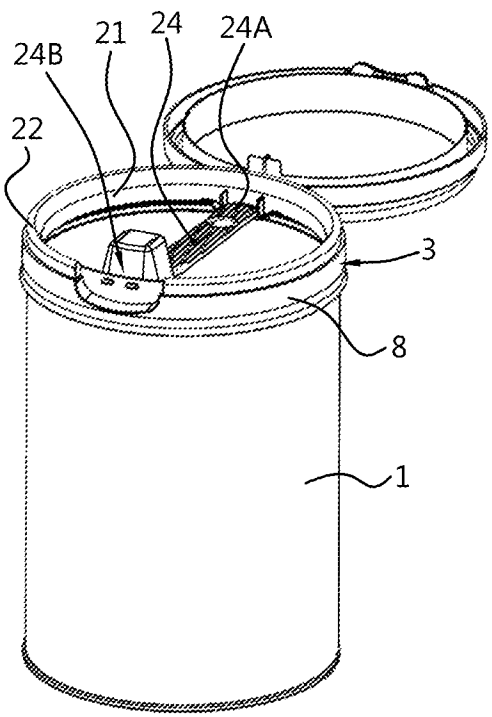
FIG. 2 shows a view in perspective of the assembly of FIG. 1, wherein the closure lid is in an open state and a utensil is arranged in the closure.
Figure 1:
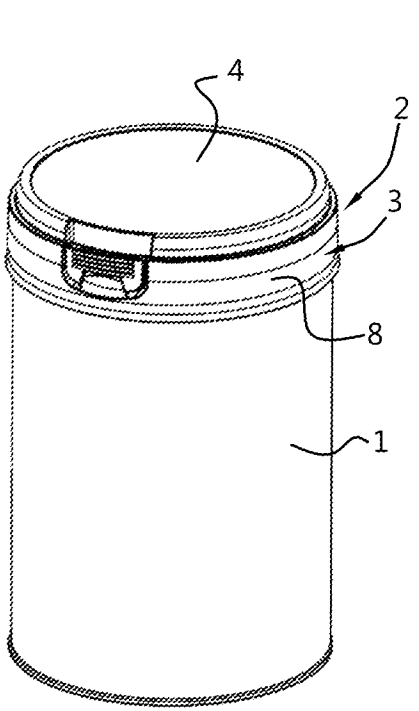
FIG. 1 shows a view in perspective of an embodiment of a closure according to the invention assembled with a container for containing a powdered product.

In FIGS. 1-3 is shown a container 1 which is suitable for containing a powdered or granular product, such as for example milk powder or baby formula. The container 1 as shown in the figure has a cylindrical shape with a bottom and an open top. The container 1 may be made of metal, plastic or another suitable material.

It is noted here that by way of non-limiting example a container for a powdered product is described, but that the present invention is not limited to the application of containers for powdered or granular products. The container may also contain other products, such as for example tablets, for example sweetener tablets or tablets of a dietary supplement, or pieces of candy and even pieces of (canned) fruit.

On top of the container 1 a closure 2 is mounted. The closure 2 selectively closes off the open top of the container 1. The closure 2 comprises an annular base 3 and a lid 4 which can be opened such that the inside of the container 1 is made accessible, which is shown in FIG. 3. The annular base 3 defines an access opening 5 to access the inside of the container 1.

The closure 2 may be made by an injection moulding process from a suitable plastics material, e.g. PP or PE.

The embodiment of the closure 2 shown in FIGS. 1-3 comprises a hinge such that the lid 4 can be swivelled from a closed position, shown in FIG. 1 to an open position shown in FIGS. 2 and 3. The hinge may be a living hinge which is integrally formed with the annular base 3 and the lid 4. Another option is to form the lid and the annular base separately and join them by hinging means. However, also an embodiment is possible wherein the lid is not coupled to the annular base by a hinge and can be entirely removed from the annular base. The way the lid and the annular base are arranged with respect to each other is not essential for the invention.

Figure 8:
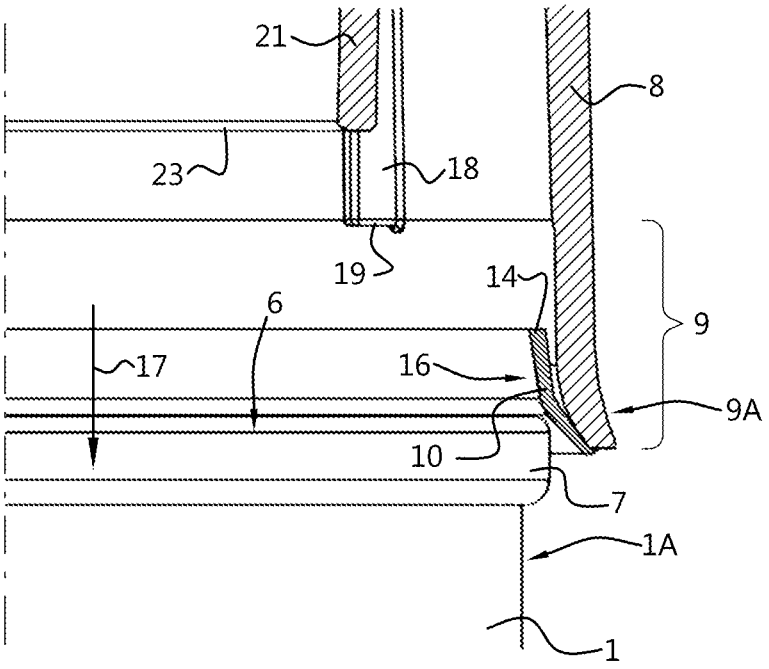
FIG. 8 shows a partly cross sectional view of a part of the closure similar to FIG. 5 during assembly with a container.

The annular base 3 is adapted to be arranged over the open top of the container 1. The container 1 comprises an upper rim 6, which includes a peripheral ledge 7 which extends radially outward with respect to the outer surface 1A of the container wall, as can be seen in FIG. 8.

Figure 4:
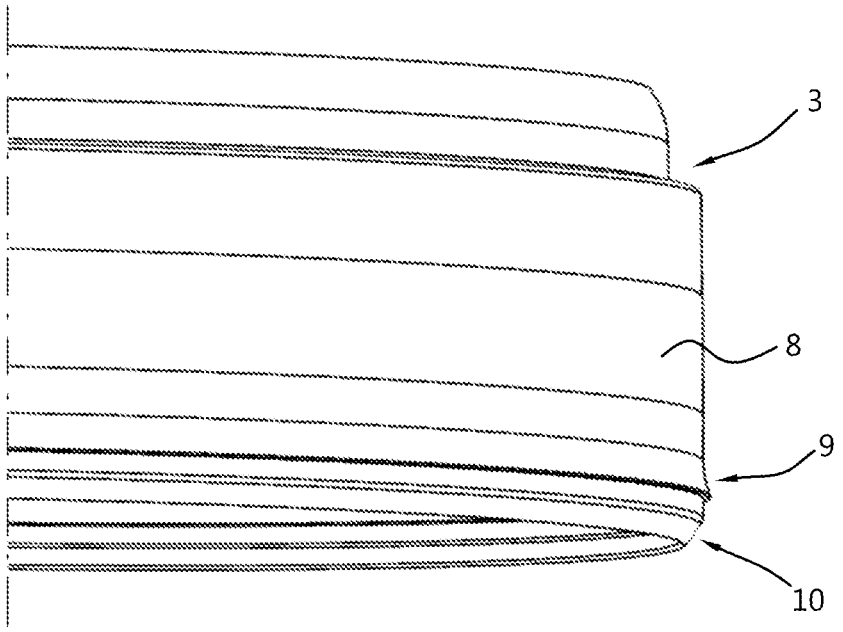
FIG. 4 shows a partly view in perspective of the closure of FIG. 1 in an unassembled initial state.

The annular base 3 comprises a peripheral skirt 8. As can be seen in FIG. 4 the peripheral skirt 8 has an integral non-removable lower end portion 9 that can be arranged over the upper rim 6 of the container 1. Non-removable in this context means that the lower end portion is not intended to be separated from the remainder of the skirt 8. The end portion 9 of the peripheral skirt 8 includes a locking rim 10 extending circumferentially from a lower end of the peripheral skirt 8 as can be seen best in FIGS. 4 and 6. The locking rim 10 is integrally formed with the skirt 8.

The end portion 9 of the peripheral skirt 8 has a wall portion 9A that increases in diameter towards the end. The wall portion 9A may be called flaring with respect to the remainder of the peripheral skirt 8. Accordingly the inner surface 11 of the wall portion 9A has an increasing diameter towards the end 9B.

Figure 6:
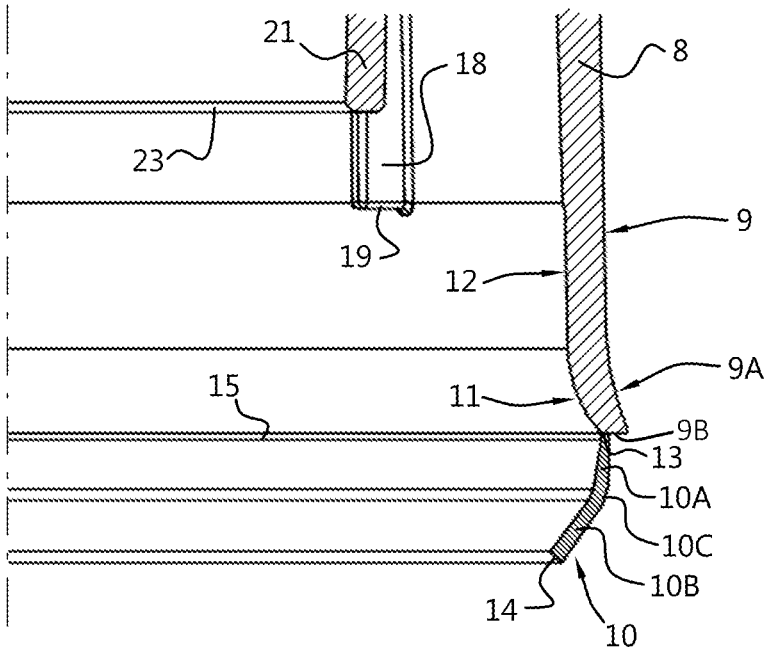
FIG. 6 shows a cross sectional view of the lower end of a part of the closure in the state of FIG. 4.
Figure 9:
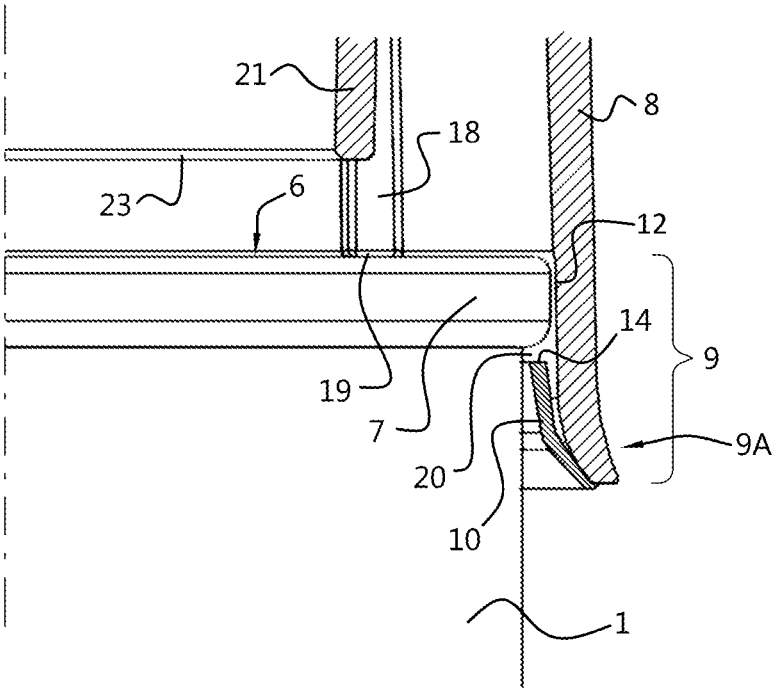
FIG. 9 shows a partly cross sectional view of a part of the closure similar to FIG. 5 after assembly with a container.

Furthermore the end portion 9 of the skirt 8 has on the inner surface an engagement surface portion 12 as can be best seen in FIG. 6. This engagement surface portion 12 has an inner diameter basically corresponding to the outer diameter of the peripheral ledge 7 of the container 1 as can be best seen in FIG. 9. The term "corresponding" meaning that there is at most a small gap 13 between the outer portion of the ledge 7 and the surface 12 as is indicated in FIG. 9.

The inner surface 11 of the wall portion 9A is curved outwardly, thus the diameter increases gradually according to a curved function. In another possible embodiment the diameter of the inner surface may increase gradually according to a linear function, resulting in the inner surface 11 being purely conical. In any case the inner surface 11 starts flush with the engagement surface portion 12 and ends at the end 9B of the skirt end portion 9 at a radial distance from the engagement surface portion 12, as can be best seen in FIG. 6. Seen from the end 9B the inner surface 11 tapers towards the engagement surface portion 12 in a continuous manner towards the smooth transition between the inner surface 11 and the engagement surface portion 12. The inner surface 11 and the engagement surface portion 12 form a continuous surface.

The locking rim 10 is connected to the peripheral skirt 8 at a proximal end 13 of the locking rim 10. The locking rim 10 also has a distal end 14, which is remote from the proximal end 13 and is a free end (see FIG. 6).

Figure 5:
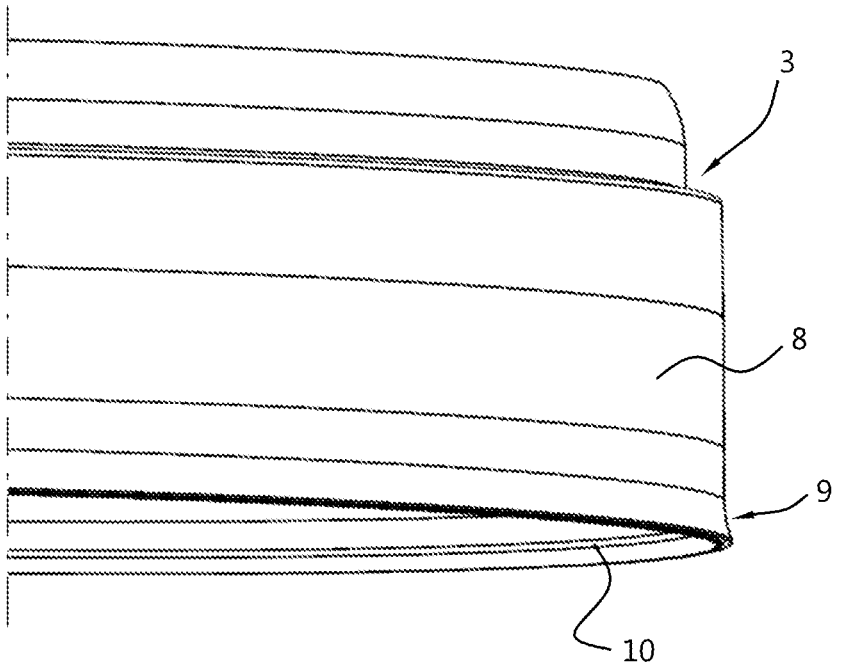
FIG. 5 shows a partly view in perspective of the closure of FIG. 1 with an inwardly folded locking rim.
Figure 7:
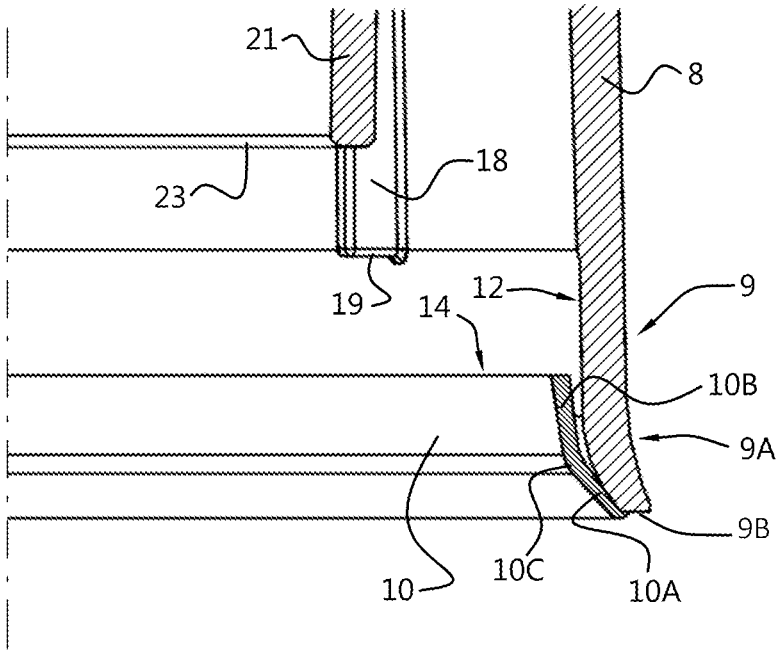
FIG. 7 shows a cross sectional view of the lower end of a part of the closure in the state of FIG. 5.

The proximal end 13 of the peripheral locking rim 10 is hingedly connected to the peripheral skirt 8. In particular the proximal end 13 is connected to the end 9B of the end portion 9 of the skirt 8. The proximal end 13 includes a circumferential hinge region 15 as can be seen in FIG. 6. The hinge region 15 allows that the peripheral locking rim 10 can be moved from an initial state, which is shown in FIGS. 4 and 6, towards a folded state, which is shown in FIGS. 5 and 7.

Because of the curved or flared shape of the wall portion 9A, the connection of the proximal end 13 of the locking rim 10 to the end 9B of the skirt end portion 9 is located radially seen further outwards than the engagement surface portion 12 of the skirt end portion 9, as can be best seen in FIG. 6. Thereby the hinge region 15 is located further outside which provides a better centring with the ledge 7 of the container when the skirt end portion 9 is positioned on the upper rim 6 of the container 1, as will be further explained below.

In the initial state (cf. FIGS. 4 and 6) the locking rim 10 extends away from the lower end 9B of the skirt 8 and thus the distal end 14 of the locking rim 10 is remote from the end portion 9A of the peripheral skirt 8. In the folded state (cf. FIGS. 5 and 7) the peripheral locking rim 10 is folded inwardly towards the inner surface 11 of the end portion 9 of the peripheral skirt 8.

The distal end 14 of the locking rim 10 has in the initial state (FIG. 6) a diameter which is smaller than the outer diameter of the peripheral ledge 7 of the container 1. When the closure 2 and the container 1 are assembled there are two options: Either the locking rim 10 is in the initial state or the locking rim is in the folded state before the closure 2 and the container 1 are put together.

When the closure 2 and the container are assembled, with the locking rim 10 in the initial state, the distal end 14 of the locking rim 10 abuts the peripheral ledge 7 of the container 1. When the closure 2, in particular the annular base 3, is moved further over the upper rim 6 of the container 1, the locking rim 10 is pushed inwardly by the ledge 7 and folded towards the inner surface 11. Thereby the locking rim 10 can move beyond the peripheral ledge 7.

The other, more preferred, option is that the locking rim 10 is brought to the folded state by a device before the closure 2 and the container 1 are assembled. In particular the locking rim 10 may be brought to the folded state just after the closure 2 is removed from the mould it is formed in. The closure 2 thus has the locking rim 10 in the folded state, shown in FIGS. 5 and 7, when the closure 2 and the container 1 are assembled together. The manufacturer of the closures 2 can thus supply the closures 2 in the state illustrated in FIGS. 5 and 7 to the filler company, which fills the container 1 and assembles the closure 2 and the container 1. The assembly step is illustrated in FIG. 8. The locking rim 10 then slides with an outer surface of the ledge 7 of the container 1 and the locking rim 10 pushed outwardly towards the inner surface 11 of the skirt 8 to be able to move beyond the ledge 7.

The exact dimensions of the upper rim of the container 1 relative to the dimensions of the annular base 3 of the closure 2, might vary, for example due to manufacturing tolerances. Consequently there might be a gap between the infolded locking rim 10 and the inner surface 11 when the locking rim 10 passes the ledge 7. However, it is also possible that the passage for the ledge 7 is too narrow even if the infolded locking rim 10 is tightly pushed against the inner surface 11. In that case, the narrowing shape of the inner surface 11 towards the upper side of the skirt 8, and the locking rim 10, also forms a narrowing guiding surface 16, as can be seen in FIG. 8. This results in that the axial movement of the peripheral skirt 8 relative to the ledge 7, indicated by arrow 17 in FIG. 8, creates a radial force pushing the lower portion 9 of the annular skirt 8 radially outward. Because the annular base 3 is made of a plastics material, which is flexible enough, such a deformation is allowed, such that the passage for the ledge 7 is temporarily increased in diameter. After the ledge 7 has passed, the wall portion 9 flexes back to its original diameter.

The distal end 14 of the locking rim 10 resiliently hinges back to engage under the peripheral ledge 7 of the container 1 when the distal end 14 has passed beyond the peripheral ledge 7. This state is shown in FIG. 9. In this state the locking rim 10 prevents that the annular base 3 can move upwardly relative to the upper rim 6 of the container 1 (thus contrary to the direction 17 indicated in FIG. 8). The annular base 3 is thus locked to the upper rim 6 of the container 1. The annular base 3 is intended to remain in the locked state on the upper end of container 1 during normal use. Therefore the annular base 3, which is locked to the upper rim 6 of the container 1, cannot be removed from the container 1 without the use of undue force.

Axially extending ribs 18 are formed on the inner side of the peripheral skirt 8. The ribs 18 have an end 19 near the end portion 9 of the peripheral skirt 8. The end 19 of the ribs 18 form a stop for the upper side of the upper rim 6 of the container as can be seen in FIG. 9. The axial distance between the end 19 of the ribs 18 and the distal end 14 of the peripheral locking rim 10 in the inwardly folded state is larger than the height of the peripheral ledge 7 of the container 1 as is visible in FIG. 9. In other words, when the ribs 18 rest with their ends 19 on the upper rim 6 of the container, there is a small spacing 20 (max. 1 mm) between the distal end 14 of the locking rim 10 and the lower side of the ledge 7, which is visible in FIG. 9. This measure allows that even though variations in the height of the ledge 7 can occur in practise, for example due to manufacturing tolerances, the annular base 3 always fits on the upper rim 6 of the container 1, albeit with a little play.

In the embodiment shown in the figures the peripheral locking rim 10 comprises a proximal portion 10A and a distal portion 10B. The proximal portion 10A extends from the proximal end 13 to an angle portion 10C. The distal portion 10B extends from the angle portion 10C to the distal end 14. In the initial state shown in FIGS. 4 and 6, the proximal portion 10A of the locking rim 10 extends substantially coaxial with the peripheral skirt 8 of the annular base. The distal portion 10B is inclined inwardly with respect to the proximal portion 10A of the locking rim 10, such that the distal end 14 of the locking rim 10 has a smaller diameter than the inner diameter of the engagement surface 12 of the end portion 9 of the skirt 8 and possibly also than the outer diameter of the ledge 7 of the container 1.

The proximal portion 10A has a gradually increasing thickness from the proximal end towards the angle portion. It starts at the proximal end 13 with a smaller thickness area, to form a hinge region 15 and then increases in thickness towards the angle portion 10C. The distal portion 10B has a substantially constant thickness.

In the embodiment shown in the figures the locking rim has an angled shape. It is however also possible to make the locking rim with an inwardly curved shape.

In the folded state shown in FIG. 7, the proximal portion 10A forms a guiding and centring surface for the ledge 7 when the closure is placed on the top side of the container 1 as is shown in FIG. 8. When the ledge 7 has passed beyond the distal portion 10B the locking rim 10 resiliently moves back inwardly and the distal portion 10B engages under the ledge 7. The proximal portion 10A of the locking rim 10 thus has a guiding and centring function, and the distal portion 10B of the locking rim 10 has a locking function.

In the practical embodiment shown in the attached figures the annular base 3 comprises an inner skirt 21 which is coaxial with the peripheral skirt 8. The inner skirt 21 is integrally connected with the peripheral skirt 8 at an upper side 22 of the annular base 3. The inner skirt 21 has a lower end 23 which in the fixed state on the container 1 is spaced above the upper rim 6 of the container las can be seen in FIG. 9. The inner skirt 21 in the fixed state on the container 1 is located radially inward from the upper rim 6 of the container 1. The inner skirt 21 defines the passage 5 through which a user can access the container 1 to remove content.

The user can remove content from the container by means of a utensil such as a scoop 24 as is shown in FIG. 2. In FIG. 2 the scoop 24 is positioned in a storing position in the annular base 3. Thereto the annular base 3 has a retaining structure 25 formed on the inner skirt 21, as can be seen in FIGS. 2 and 3. The retaining structure receives an end 24A of the scoop 24 to retain it in the storing position. Thereto it has retaining members 26. On the diametrically opposite side of the inner skirt 21 a similar retaining structure, which is not visible in the view of FIGS. 2 and 3, is formed to retain the opposite end 24B of the scoop 24.

The invention may be summarized by the following clauses:

1. Closure (2) for a container (1), wherein said container (1) has an open top side defined by an upper rim (6) comprising an outwardly extending peripheral ledge (7) surrounding said open top side, the closure (2) comprising an annular base (3) to be fixed to the upper rim (6) of the container (1) and defining an access opening (5) to the container (1), and the closure (2) further comprising a lid (4) moveable relative to the annular base (3) between a closed position, in which the lid (4) covers the access opening (5), and an open position, in which the access opening (5) is unblocked by the lid (4), the annular base (3) comprising a peripheral skirt (8) which has an end portion (9) adapted to be arranged over the upper rim (6) of the container (1), and furthermore comprising a peripheral locking rim (10) integrally formed on said end portion (9) of the peripheral skirt (8), said peripheral locking rim (10) having a proximal end (13) and a distal end (14), said proximal end (13) of the peripheral locking rim (10) being hingedly connected to the peripheral skirt (8), allowing the peripheral locking rim (10) to be moved to a folded state, in which the peripheral locking rim (10) is folded inwardly towards an inner surface of the end portion (9) of the peripheral skirt (8), such that, when the locking rim (10) is in the folded state, the distal end (14) thereof can move beyond and engage under the peripheral ledge (7) of the container (1) to lock the annular base (3) to the upper rim (6) of the container (1), characterized in that the end portion (9) of the skirt (8) has on the inner surface an engagement surface portion (12) with an inner diameter basically corresponding to the outer diameter of the peripheral ledge (7) of the container and a widening surface portion (11) having a larger inner diameter than the engagement surface portion (12).

2. Closure according to clause 1, wherein the widening surface portion (11) has a gradually increasing inner diameter from the engagement surface portion (12) towards the end of the peripheral skirt (8).

3. Closure according to clause 1 or 2, wherein the peripheral locking rim (10) comprises a proximal portion (10A) and a distal portion (10B), the proximal portion (10A) extending from the proximal end (13) to an angle portion (10C), the distal portion (10B) extending from the angle portion (10C) to the distal end (14), and wherein in an initial state the distal portion (10B) is inclined inwardly with respect to the proximal portion (10A) of the locking rim (10).

4. Closure according to clause 3, wherein in the initial state the proximal portion (10A) of the locking rim (10) extends substantially in alignment or concentric with the peripheral skirt (8) of the annular base (3).

5. Closure according to clause 3 or 4, wherein the proximal portion (10A) has a gradually increasing thickness from the proximal end (13) towards the angle portion (10C).

6. Closure according to any of the clauses 3-5, wherein the distal portion (10B) has a substantially constant thickness.

7. Closure according to clause 1 or 2, wherein the locking rim (10) has an inwardly curved shape.

8. Closure according to any of the preceding clauses, wherein the annular base (3) furthermore comprises an inner skirt (21) which is coaxial with the peripheral skirt (8) and is integrally connected with the peripheral skirt (8) at an upper side.

9. Closure according to clause 8, wherein the inner skirt (21) has a lower end (23) which in the fixed state on the container (1) is spaced above the upper rim (6) of the container (1).

10. Closure according to clause 8 or 9, wherein the inner skirt (21) in the fixed state on the container (1) is located radially inward from the upper rim (6) of the container (1).

11. Closure according to any of the preceding clauses, wherein the peripheral skirt (8) has axially extending ribs (18) on the inner side, wherein the ribs (18) have an end (19) near the end portion (9) of the peripheral skirt (8), wherein said end (19) of the ribs (18) from a stop for the upper rim (6) of the container (1).

12. Closure according to clause 11, wherein the axial distance between the end (19) of the ribs (18) and the distal end (10B) of the peripheral locking rim (10) in the inwardly folded state is larger than the height of the peripheral ledge (7) of the container (1).

13. Closure according to any of the preceding clauses, wherein the annular base (3) and the lid (4) are connected by a hinge.

14. Closure according to any of the preceding clauses, wherein the annular base (3) and the lid (4) are formed in one piece.

15. Closure according to any of the clauses 1-13, wherein the annular base (3) and the lid (4) are separately formed parts which are assembled to form the closure.

16. Closure according to any of the preceding clauses, wherein the annular base (3) has retaining members (26) to retain a utensil (24) adapted to take product from the container (1).

17. Closure according to any of the preceding clauses, wherein the lid has retaining members to retain a utensil adapted to take product from the container.

18. Method for manufacturing a closure according to any of the preceding clauses, wherein the closure (1) is formed by injection moulding.

19. Method according to clause 18, wherein the locking rim (10) of the closure is brought into the folded state just after it is removed from the injection mould.

20. Assembly of a closure (2) according to any of the clauses 1-17 and a container (1).

21. Assembly according to clause 20, wherein the container contains a powdered or granular product.

22. Assembly according to clause 20, wherein the container contains a product in the form of tablets.

The invention claimed is:

1. A closure to be fixed to an upper rim of a container, the closure comprising:

an annular base comprising a peripheral skirt which has an integral non-removable end portion adapted to be arranged over an upper rim of a container, and furthermore comprising a peripheral locking rim integrally formed on said end portion of the peripheral skirt, said peripheral locking rim having a proximal end and a distal end, said proximal end of the peripheral locking rim being hingedly connected to the peripheral skirt, allowing the peripheral locking rim to be moved to a folded state, in which the peripheral locking rim is folded inwardly towards an inner surface of the end portion of the peripheral skirt, wherein the end portion of the skirt has on the inner surface an engagement surface portion with an inner diameter and a widening surface portion having a gradually increasing inner diameter from the engagement surface portion towards an end of the peripheral skirt; and a lid moveable relative to the annular base between a closed position, in which the lid covers an access opening, and an open position, in which the access opening is unblocked by the lid, wherein the inner diameter of the widening surface portion increases gradually according to a curved function, and wherein the widening surface portion adjoins the engagement surface portion in a flush manner.

2. The closure according to claim 1, wherein the end portion of the skirt has a wall portion that increases in diameter towards an end of the end portion of the peripheral skirt.

3. The closure according to claim 1, wherein the proximal end of the locking rim is connected to an end of the end portion of the peripheral skirt.

4. The closure according to claim 1, wherein the proximal end of the locking rim is located radially outward with respect to the engagement surface portion.

5. The closure according to claim 1, wherein the peripheral locking rim comprises a proximal portion and a distal portion, the proximal portion extending from the proximal end to an angle portion, the distal portion extending from the angle portion to the distal end, and wherein in an initial state the distal portion is inclined inwardly with respect to the proximal portion of the locking rim.

6. The closure according to claim 5, wherein in the initial state the proximal portion of the locking rim extends substantially in alignment or concentric with the peripheral skirt of the annular base.

7. The closure according to claim 5, wherein the proximal portion has a gradually increasing thickness from the proximal end towards the angle portion.

8. The closure according to claim 5, wherein the distal portion has a substantially constant thickness.

9. The closure according to claim 1, wherein the locking rim has an inwardly curved shape.

10. The closure according to claim 1, wherein the annular base furthermore comprises an inner skirt which is coaxial with the peripheral skirt and is integrally, connected with the peripheral skirt at an upper side.

11. The closure according to claim 1, wherein the annular base and the lid are connected by a hinge.

12. The closure according to claim 1, wherein the annular base and the lid are formed in one piece.

13. The closure according to claim 1, wherein the annular base and the lid are separately formed parts which are assembled to form the closure.

14. The closure according to claim 1, wherein the annular base has retaining members to retain a utensil adapted to take product from the container.

15. The closure according to claim 1, wherein the lid has retaining members to retain a utensil adapted to take product from the container.

* * * * *